US007226314B2

(12) United States Patent
Lang et al.

(10) Patent No.: US 7,226,314 B2
(45) Date of Patent: Jun. 5, 2007

(54) CONNECTOR AND GUIDE PLACEMENT MEMBER

(75) Inventors: Harold Keith Lang, Cary, IL (US); Emmanuel G. Banakis, Naperville, IL (US); Kent E. Regnier, Lombard, IL (US); Jennifer Swenson, Oak Park, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/245,739

(22) Filed: Oct. 7, 2005

(65) Prior Publication Data

US 2006/0189211 A1 Aug. 24, 2006

Related U.S. Application Data

(60) Provisional application No. 60/655,673, filed on Feb. 23, 2005.

(51) Int. Cl.
*H01R 13/648* (2006.01)

(52) U.S. Cl. ..... 439/607

(58) Field of Classification Search ..... 439/607, 439/483, 492–499, 260, 609–610
See application file for complete search history.

(56) References Cited

U.S. PATENT DOCUMENTS 5,934,935 A 8/1999 Kameyama
6,435,897 B1 8/2002 Paul et al.
6,755,680 B2 * 6/2004 Okamura et al. ..... 439/483
6,902,432 B2 * 6/2005 Morikawa et al. ..... 439/607
2002/0115333 A1 8/2002 Self
2006/0040556 A1 * 2/2006 Neer et al. ..... 439/607
2006/0134985 A1 * 6/2006 Reed et al. ..... 439/607
2006/0189180 A1 8/2006 Lang et al.
2006/0189199 A1 8/2006 Lang et al.

OTHER PUBLICATIONS

International Search Report in International Application No. PCT/US2005/044758, Mar. 30, 2006, the PCT counterpart of the pending application.

* cited by examiner

*Primary Examiner*—J. F. Duverne
(74) *Attorney, Agent, or Firm*—Thomas D. Paulius

(57) ABSTRACT

A shroud that forms a guide channel for a receptacle connector is disclosed and it has the shape of an inverted U-shape, with a press tab for engaging a mating connector. The shroud has notches and tabs formed on it that serve to orient the mating connector for entry into the shroud. A placement member is described that holds the connector and the shroud together as a single unit for robotic placement of the shroud and connector in preselected positions on the circuit board.

21 Claims, 9 Drawing Sheets

CONNECTOR AND GUIDE PLACEMENT MEMBER

REFERENCE TO RELATED APPLICATIONS

This application claims priority from prior U.S. provisional Patent Application No. 60/655,673, filed Feb. 23, 2005.

BACKGROUND OF THE INVENTION

The present invention relates generally to connector shrouds, and more particularly to a shroud and placement member that cooperate as an engaged assembly for mounting the shroud and an associated connector on a circuit board.

Most small form factor pluggable style connectors are surface mounted to a circuit board and then are enclosed in a metal or metallic shielding cage. The use of this external cage requires that the connector be first mounted to a circuit board, and then the cage must be mounted to the circuit board. Many times the connector may be of a surface mount style, while the shielding cage is of a press fit style, meaning that each of the two components must be separately applied to the circuit board. This adds cost to the assembly process of the electronic device the connector and cage are used in.

In order to speed the assembly process and to reduce the costs involved, it is desirable that the connector and cage somehow be formed so as top enable their placement by a robotic assembler. Also, inasmuch as components other than the receptacle connector are applied to the supporting circuit board, it is desirable to provide a means for guiding a plug connector into engagement with the receptacle connector which also provides a measure of electrical shielding.

The present invention is directed to placement member that overcomes the aforementioned disadvantages and which facilitates installation of such connector and guide assemblies.

SUMMARY OF THE INVENTION

Accordingly, it is a general object of the present invention to provide a connector and shroud, or guide member, that are easily mounted to a circuit board by automated means.

Another object of the present invention is to provide a metal shroud for use with an associated circuit board connector, the shroud being positioned away from the connector and having a pressure tab that extends toward the connector to define a contact member that engages the exterior of a corresponding mating plug connector.

A further object of the invention is to provide a shroud having at least one interior biasing member that applies a biasing force onto a mating plug connector to properly direct the plug connector into contact with the circuit board connector, and the shroud further having a means for engaging two opposing sides of the plug connector to align the plug connector with the circuit board connector.

A still further object of the present invention is to provide a placement member that is insertable into the shroud and which has a forward engagement face that mates with the circuit board connector so that the circuit board connector and the shroud may be properly spaced apart as an assembly and the placement members having one or more planar surfaces disposed thereon that may be used for vacuum deposit onto a circuit board.

Yet another object of the present invention is to provide an insulative insert that is insertable into and engageable with the metal shroud, the insert having additional means for engaging a surface mount circuit board connector, the engagement means taking the form of a pair of engagement arms, or a blade member that engages a portion of the circuit board connector, while supporting the shroud in its proper distance and orientation with respect to the circuit board connector so that the circuit board connector and shroud may be placed as a unit, onto a circuit board.

Still yet another object of the present invention is to provide a metal guide member for use with an associated receptacle connector that is mounted to a circuit board, the guide member providing a means for guiding in an opposing plug connector into alignment and engagement with the receptacle connector, the guide member having three sides defining a hollow interior cavity that receives the plug connector therein, the guide member including a plurality of strengthening ribs formed therein that modify the cross-section of the sides of the guide member to provide increased resistance to bending.

The present invention accomplishes these and other objects by way of its structure. In a first embodiment of the invention, a shroud, or guide, is provided having a top and two spaced-apart sidewalls. The shroud has a general inverted U-shape, when viewed from an end, and when placed on a circuit board spaced apart from a connector mounted to the circuit board, it provides a channel that may guide an opposing connector into engagement with the circuit board connector. The shroud also serves to retain the mating connector in place.

The shroud has a front face and a rear face, and a press tab extends outwardly from the shroud along the rear face in a cantilevered fashion and engages an upper surface of the mating connector when it is inserted into the shroud. The front face of the shroud has one or more tabs formed thereon, and these tabs serve to orient the mating connector when they are properly received within corresponding slots, or notches, disposed on the mating connector housing.

The rear face of the shroud also may include two tabs that are bent inwardly upon the shroud to form a pair of spring arms, and these spring arms preferably extend lengthwise within the interior shroud toward the rear of the shroud. The spring arms terminate in free ends, which are captured by other tabs to define an overall biasing structure that resembles a leaf spring. These spring arms serve to exert a downward pressure onto the housing of the mating connector to ensure that it will be inserted into the shroud and mated with the circuit board connector properly.

The shroud may further include one or more slots or recesses in its top wall that are engaged by clip or lugs formed on the mating connector as part of a mating mechanism. The shroud can also include a pair of notches that are formed in the shroud sidewalls, and preferably along the front edges thereof. These notches engage corresponding lugs formed on the mating connector housing. With the present invention, the spring arms of the shroud serve to orient and position the mating connector in the vertical direction and the notch-lug combination serve to orient the mating connector in the horizontal direction.

In another embodiment of the present invention, a placement, or insert, member is provided that serves to engage both the circuit board connector and the shroud, and it positions them in their spacing at which they would be mounted to a circuit board. As such, the placement member forms an assembly or unit with the shroud and connector that may be robotically placed onto the circuit board. The placement member includes a plurality of planar surfaces disposed thereon in either or both horizontal and vertical planes.

The placement member include a body portion that fits in the interior of the shroud and it has notches and recesses in similar locations to those used on the mating connector so that it will be properly oriented in the shroud. The placement member preferably includes a primary clip member disposed on the top of the placement member and which engages the top wall of the shroud. A pair of rails may be provided in opposition tot he primary clip with guide surfaces to facilitate assembly of the placement member to the shroud.

The placement member also preferably includes an extending tab that will pass over the top of the circuit board connector and engages the press tab formed in the shroud. A pair of secondary clips are also provided along one face of the placement member and these secondary clips extend into engagement with the circuit board connector, preferably on the underside thereof so that they exert an upward directed engagement force on the connector while the placement member rear tab and the shroud press tab exert a downward directed force on the connector. By the use of the balanced force arrangement, the circuit board connector, shroud and placement member are maintained together as a unit during assembly, transportation and robotic application.

These and other objects, features and advantages of the present invention will be clearly understood through a consideration of the following detailed description

BRIEF DESCRIPTION OF THE DRAWINGS

In the course of this description, references will be made to the drawings, in which.

DETAILED DESCRIPTION OF THE PREFERRED EMBODIMENTS

Figure 1:
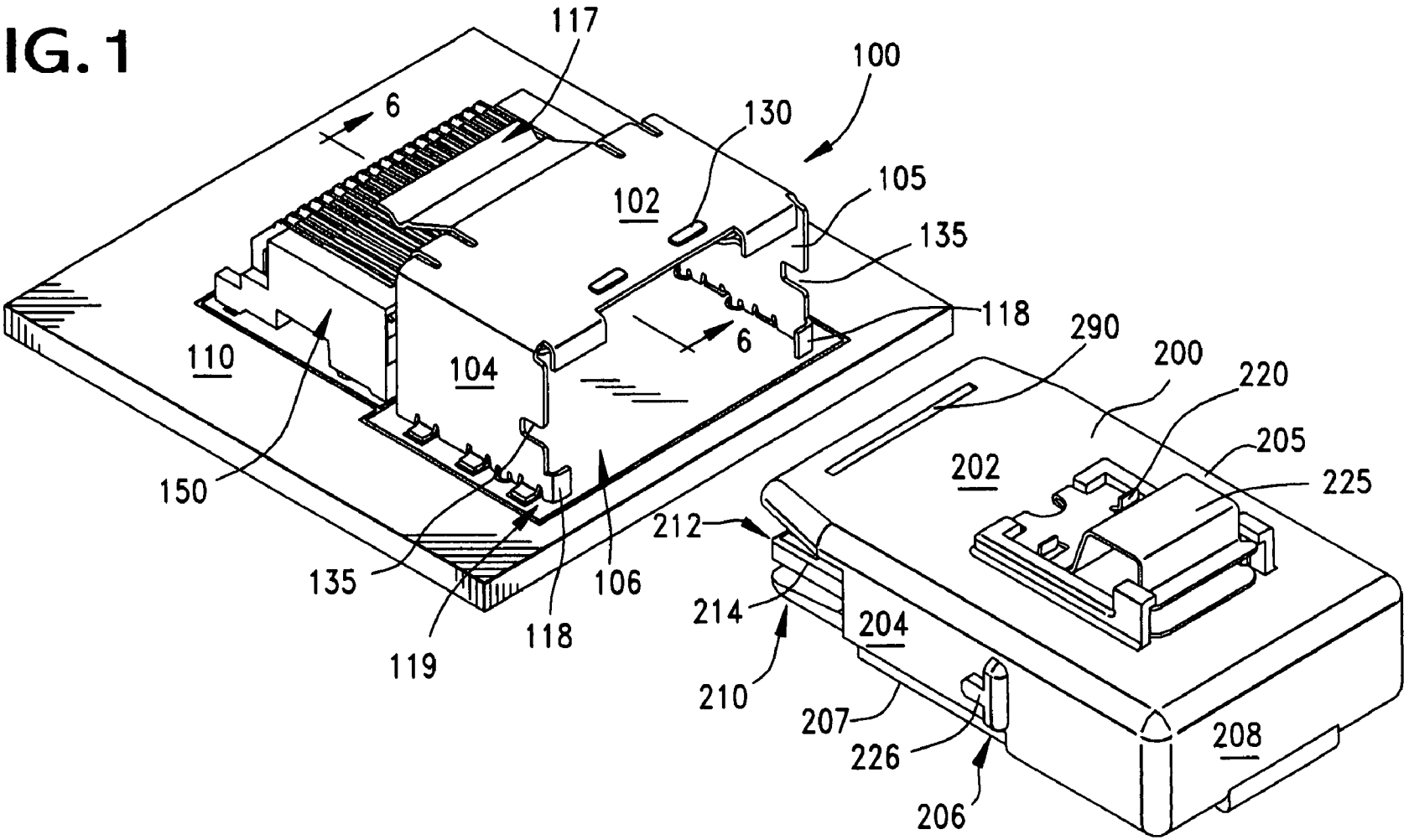
FIG. 1 is a perspective view of a connector and shroud constructed in accordance with the principles of the present invention and with a plug connector shown in alignment with but spaced apart from the connector and shroud.

FIG. 1 illustrates a first embodiment of the invention, namely a shroud, or guide 100, having a top wall 102 and two spaced-apart sidewalls 104. 105. The shroud 100 has a general inverted U-shape when viewed from an end, and when placed on a circuit board 110 spaced apart from a connector 150 mounted to the circuit board 110. The shroud 100 provides a hollow channel 106 that may guide an opposing (plug-style) connector 200 into engagement with the circuit board connector 150. The shroud 100 also serves to retain the mating connector 200 in place.

Figure 2:
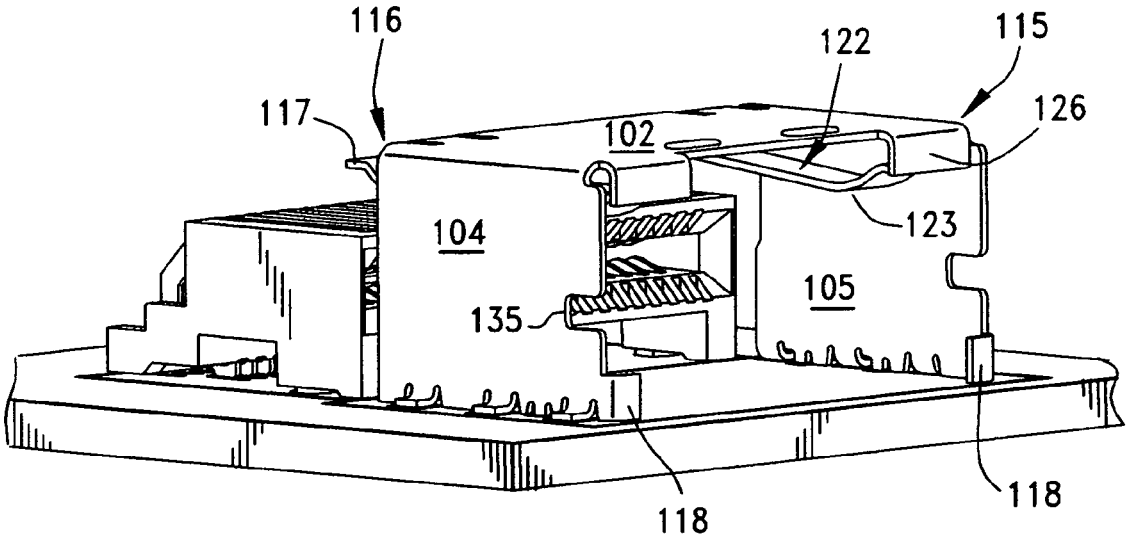
FIG. 2 is the same view as FIG. 1, but taken from a low angle and with the plug connector removed for clarity to illustrate parts of the circuit board connector through the interior of the shroud.
Figure 6:
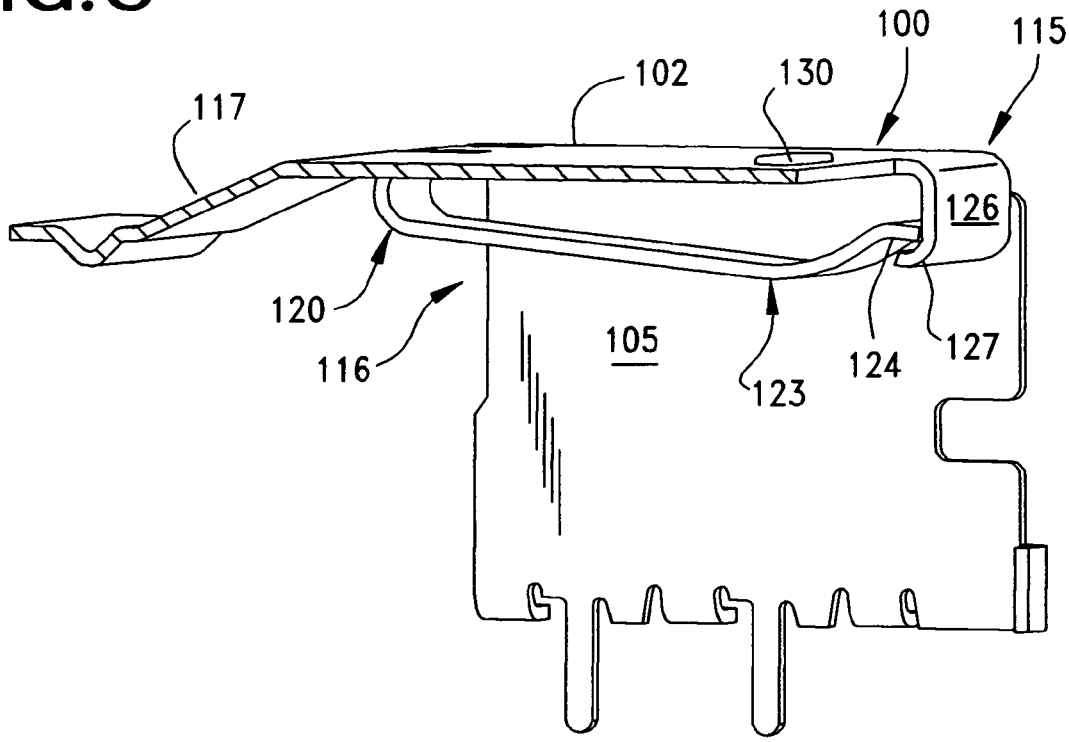
FIG. 6 is a sectional view of the shroud of FIG. 1, taken along lines 6—6 thereof, and the circuit board connector removed from clarity.
Figure 6A:
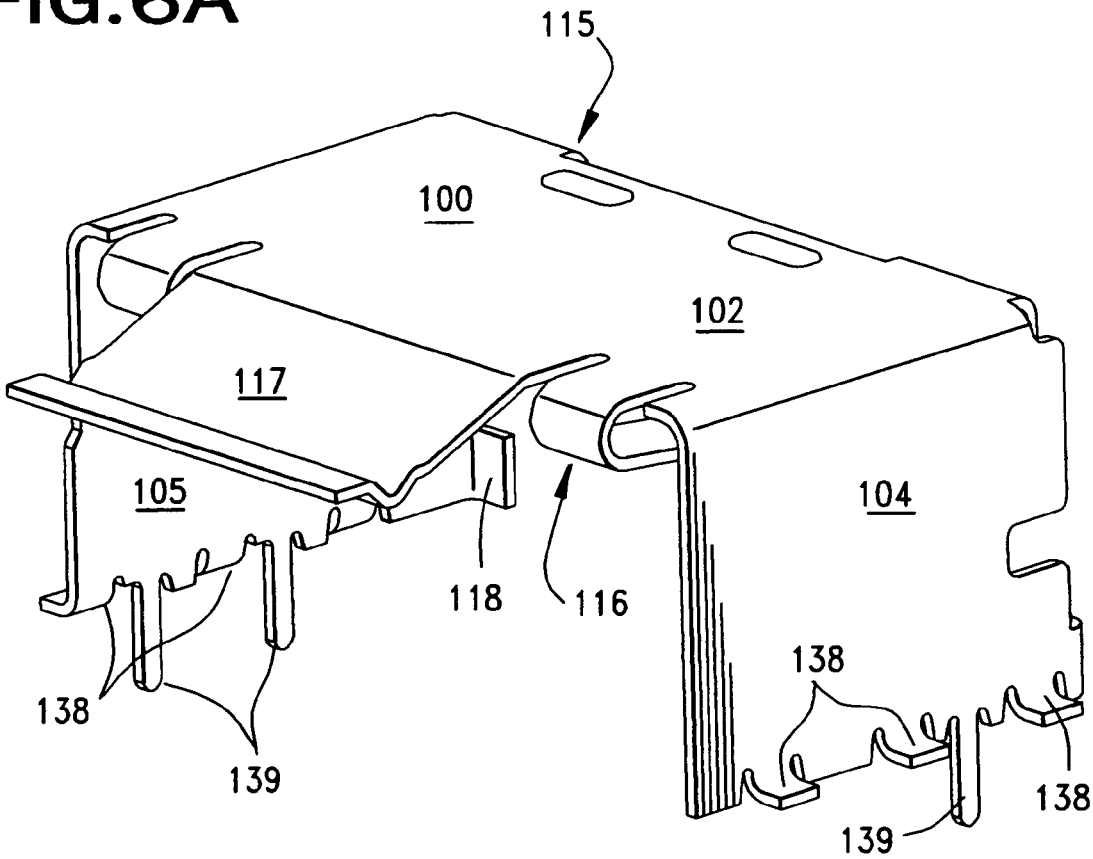
FIG. 6A is a perspective view of the shroud, taken from the top and illustrating its interior and its circuit board mounting members.
Figure 7:
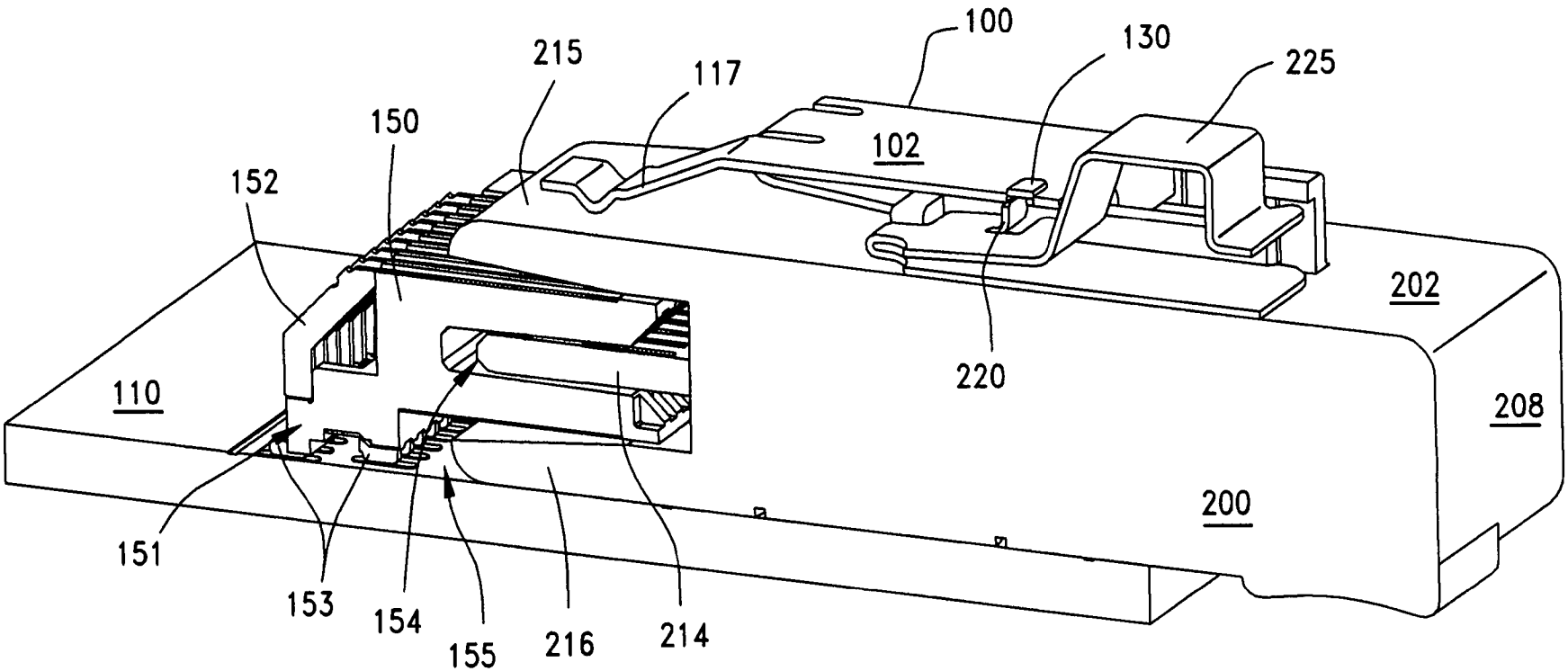
FIG. 7 is a sectional view of FIG. 1, taken generally along lines 6—6 thereof, but with the plug connector in place within the shroud and mated to the circuit board connector.

As shown in FIGS. 2 & 6A, the shroud 100 has a front face 115 and a rear face 116. A press tab, or press arm 117, is formed with the shroud 100, and the tab 117 extends outwardly from the shroud 100 along the rear face 116 in a cantilevered fashion. (FIG. 6A.) The purpose of this press tab 117 is to engage an upper surface 202, preferably a channel, or recess 290, of the mating connector 200 when it is inserted into the interior channel 106 of the shroud 100. The front face 115 of the 100 shroud has one or more tabs 118 formed thereon. These tabs 118 are formed along an edge of the side walls, and preferably along the front face 115 of the shroud 100, and as shown best in FIG. 1, they are disposed along the base 119 of the two shroud sidewalls 104, 105. These tabs 118 serve to orient the mating connector 200 when they are properly received within corresponding slots, or notches 207, disposed on the mating connector housing 200.

Figure 3:
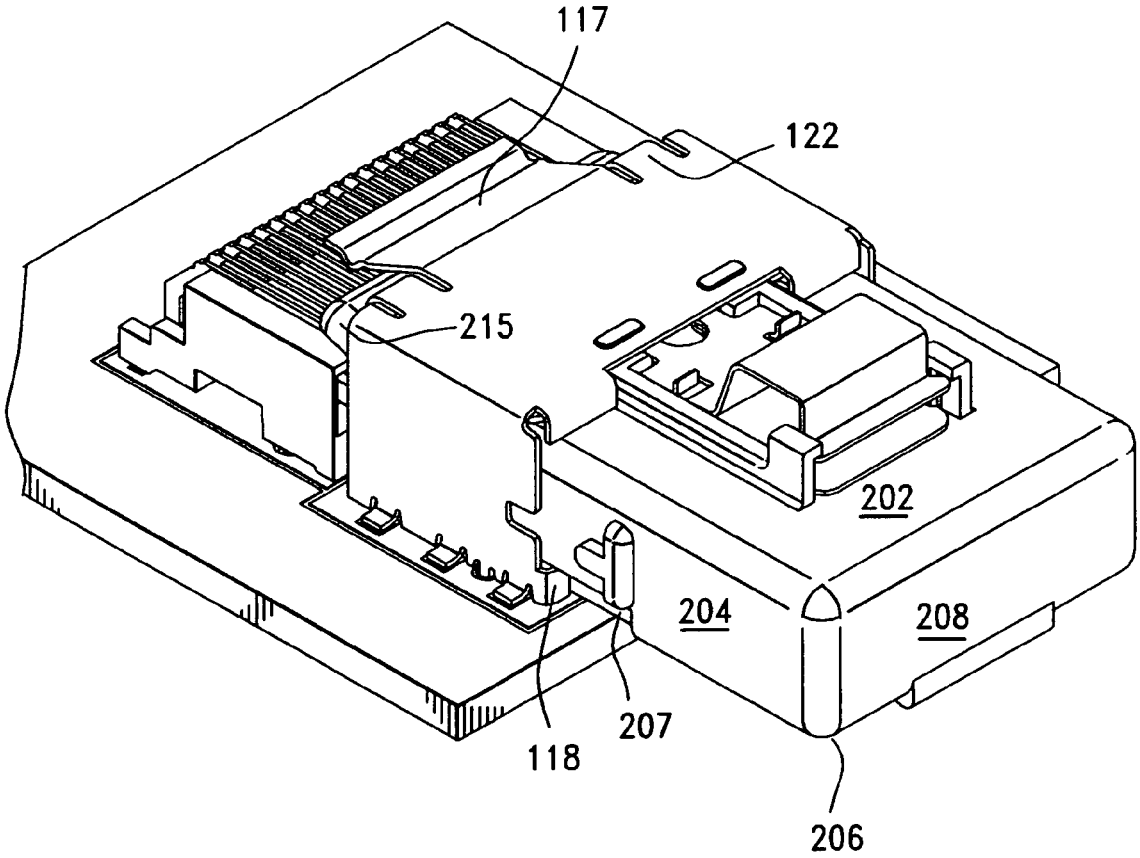
FIG. 3 is the same view as FIG. 1, but with the plug connector partially inserted into the shroud.
Figure 5:
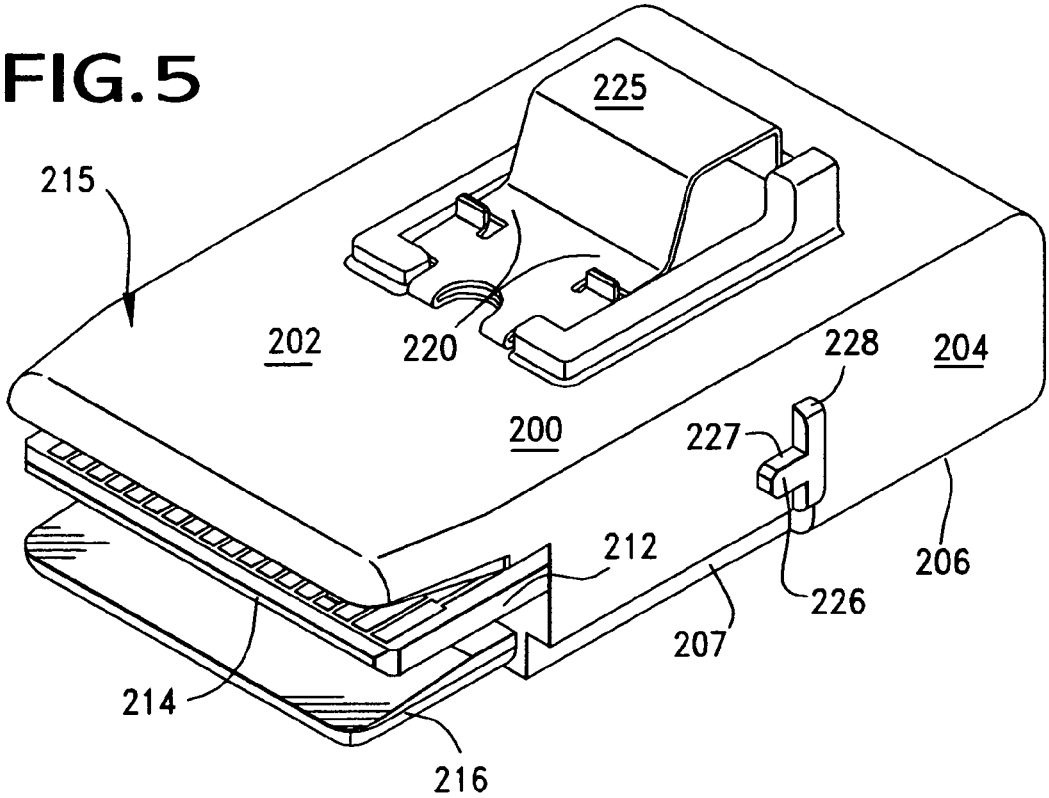
FIG. 5 is a perspective view of the plug connector of FIG. 1, taken from the front thereof.

The mating connector 200, as best illustrated in FIGS. 1, 3 & 5, has a generally polygonal structure, and is shown in the drawings as generally a solid rectangle with a top surface 202, two side walls 204, 205, a bottom wall 106 and a rear wall 208. Cables will usually exit from the rear wall, but they have been omitted from the drawings for clarity. The front face 210 of the connector defines a mating face of the connector and in applications such as shown in the drawings, the mating connector 200 will take the form of a plug connector with a forwardly projecting mating blade 212, typically the edge of a circuit card 214. The top surface 202 (and in the drawings, bottom surface 106) may have an extension 215 that extend forwardly above and below the circuit card 214.

Figure 4:
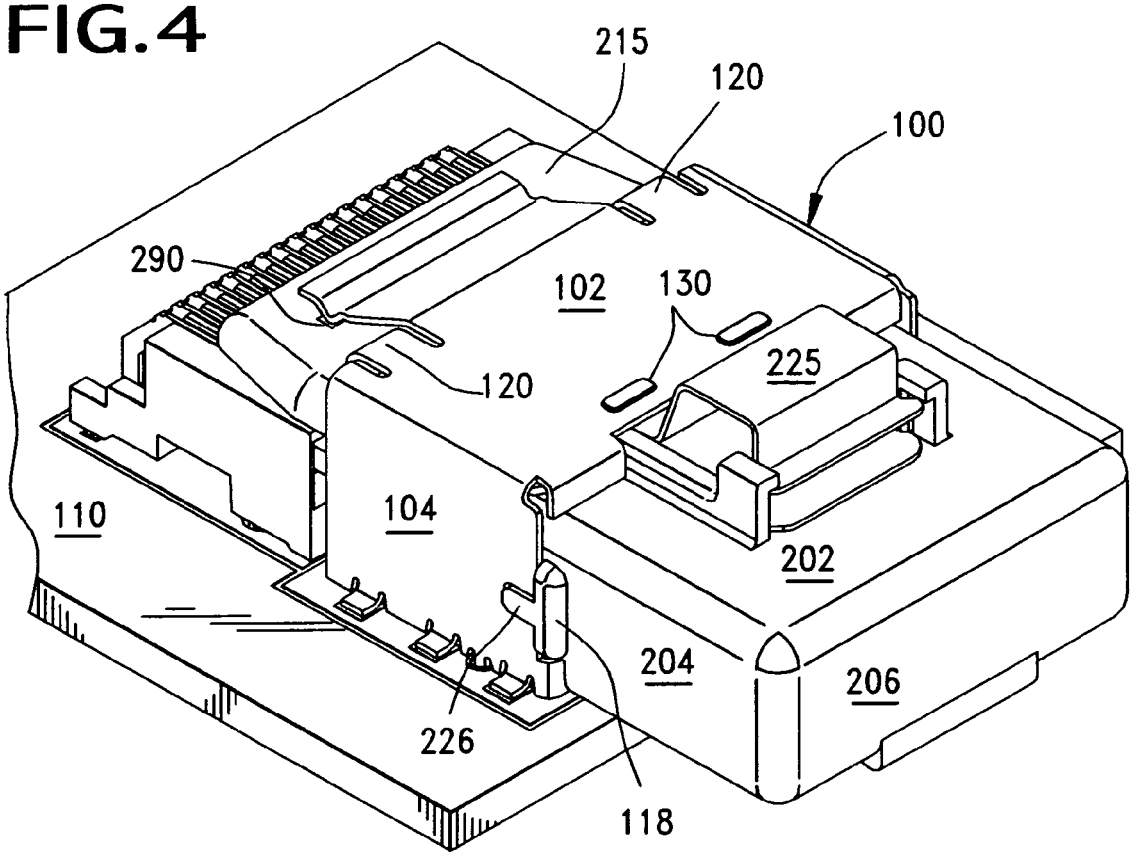
FIG. 4 is the same view as FIG. 3, but with the plug connector fully engaged in the shroud and in mating engagement with the circuit board connector.

The shroud press tab 117 is bent downwardly to impart a slight bias to it so that it will slidingly or abuttingly contact the top surface 202 of the mating connector 200, and in particular, the top extension 215 thereof. This type of engagement is shown best in FIG. 4, and the press tab edge preferably engages a recess 290, when either an audible signal The rear face 116 of the shroud 100 also may include two tabs 120 that are bent inwardly upon the shroud 100, into its interior channel 106, to form a pair of spring arms 122, and these spring arms 122 preferably extend lengthwise within the interior channel 106 of the shroud 100 toward the front face 115 of the shroud 100. As shown in FIG. 6, the spring arms 120 have curved backbone portions 123 terminate that in free ends 124. These free ends engage other tabs 126 that define inner ledges 127 against which the free ends 124 are biased. The free ends 124 of the spring arms 122 are in essence "captured" in place by the other tabs 126 to define an overall biasing structure that resembles a leaf spring. These spring arms 122 serve to exert a downward pressure onto the housing of the mating connector 200. Particularly, the upper surface 202 thereof. This downward bias ensures that the mating connector 200 is inserted into the shroud properly so that it slides along the circuit board 110 and mated with the circuit board connector 150 properly.

The shroud 100 may further include one or more slots or recesses 130 in its top wall 102 that are engaged by clips, or lugs, 220 that are preferably formed on the mating connector 200 as part of a mating mechanism. These lugs 220 are moved in and out of engagement with the slots 130 by means of a push-type button 225, shown as formed from sheet metal.

The shroud 100 may also include a pair of notches 135 that are formed in the shroud sidewalls 104, 105 and preferably along the front edges thereof. These notches 135 engage corresponding lugs 226 formed on the mating connector housing 200. The lugs 226 have an overall T-shape when viewed from the side, with a center leg 227 that is received within the corresponding shroud notch 135 and two other legs that form a base 228 that is perpendicular the center leg. The base 228 serves as a stop when it abuts the edge of the sidewalls 104, 105. With the present invention, the spring arms 122 of the shroud 100 serve to orient and position the mating connector 200 in the vertical direction and the notches 135 and lugs 226 further cooperate to orient the mating connector 200 in the horizontal direction.

As shown in FIG. 6A, the shroud 100 may also include surface mount feet 138 that are formed along the bottom edges of the two sidewalls 104, 105. For purposes of properly orienting the shroud 100 on the circuit board 110, the shroud 100 may also include through hole pins 139 that are arranged in a polarizing pattern along the bottom edges of the sidewalls 104, 105.

The circuit board connector 150, to which the mating connector 200 mates, is a receptacle style connector with an insulative housing 151 that supports a plurality of conductive terminal 152, which are shown as having surface mount feet 153 that are connected to conductive pads arranged on the surface of the circuit board 110. The connector includes a card-receiving cavity 154 that receives the edge card 214 of the mating connector 200, and it includes a second cavity 155 beneath the first cavity 154. This second cavity receives the lower extension portion 2316 of the mating connector 200 and as such, it provides a measure of polarization to the connector so that the mating connector 200 will be properly mated therewith.

In another embodiment of the present invention, as illustrated in FIGS. 8–12, a placement, or insert, member 300 is provided that serves to engage both the circuit board connector 150 and the shroud 100 in a manner so that it positions them in their spacing at which they would be mounted to the circuit board 110. As such, the placement member 300 forms an assembly or unit with the shroud 100 and the connector 150 that may be robotically placed as a whole onto the circuit board 110. The placement member includes 300 a plurality of planar surfaces disposed thereon in either or both horizontal and vertical planes to permit a vacuum pick and place pie to contact.

The placement member 300 include a body portion 302 that fits in the interior channel 106 of the shroud 100 and it has notches 303 and recesses in similar locations to those used on the mating connector 200 so that the placement member 300 will be properly oriented in the shroud 100. The placement member 300 preferably includes a primary clip member 305 disposed on the top 304 of the placement member 300 and which engages the top wall 102 of the shroud 100. This clip 305 extends forwardly in a cantilevered fashion over a pair of rails 306 (FIG. 8) that are aligned in opposition to the primary clip 305. These rails 306 may include guide surfaces 310 at their forward ends so as to facilitate assembly of the placement member 300 to the shroud 100. The rails are spaced apart widthwise along the placement member top, and they preferably extend underneath the arms 304 of the primary clip 305. As shown in the drawings, the placement member may be easily inserted into the interior of the shroud 100 from the front. The top surface of the clip 305 is preferably planar so that it may serve as a vacuum pick and place surface.

The placement member 300 also preferably includes a forwardly extending protective tab 312 that will pass over the top of the circuit board connector 150 (and the exposed terminals thereof) and engages the press tab 117 formed at the shroud rear end 116. This forward tab 312 extends past the leading edge 320 of the placement member body 302. A pair of secondary clips 314 are also provided along the forward face of the placement member 300 and these secondary clips 314 extend into engagement with the circuit board connector 150, preferably on the underside thereof and into the lower cavity 155, as shown best in FIG. 12. This is so they can exert an upward directed engagement force by way of their hook ends 325 on the connector 150 while the placement member forward tab 312 and the shroud press tab 117 exert a downward directed force on the connector 150. By the use such of the balanced force arrangement, the circuit board connector 150, shroud 100 and placement member 300 are maintained together as a unit during assembly, transportation and robotic application. The placement member 300 further may include, if desired, tabs, or stops 318 that are positioned along the sides of the placement member 300. These tabs or stops are received in the notches of the shroud side walls, as shown best in FIG. 9, and they also serve to orient the placement member properly within the shroud.

Figure 8:
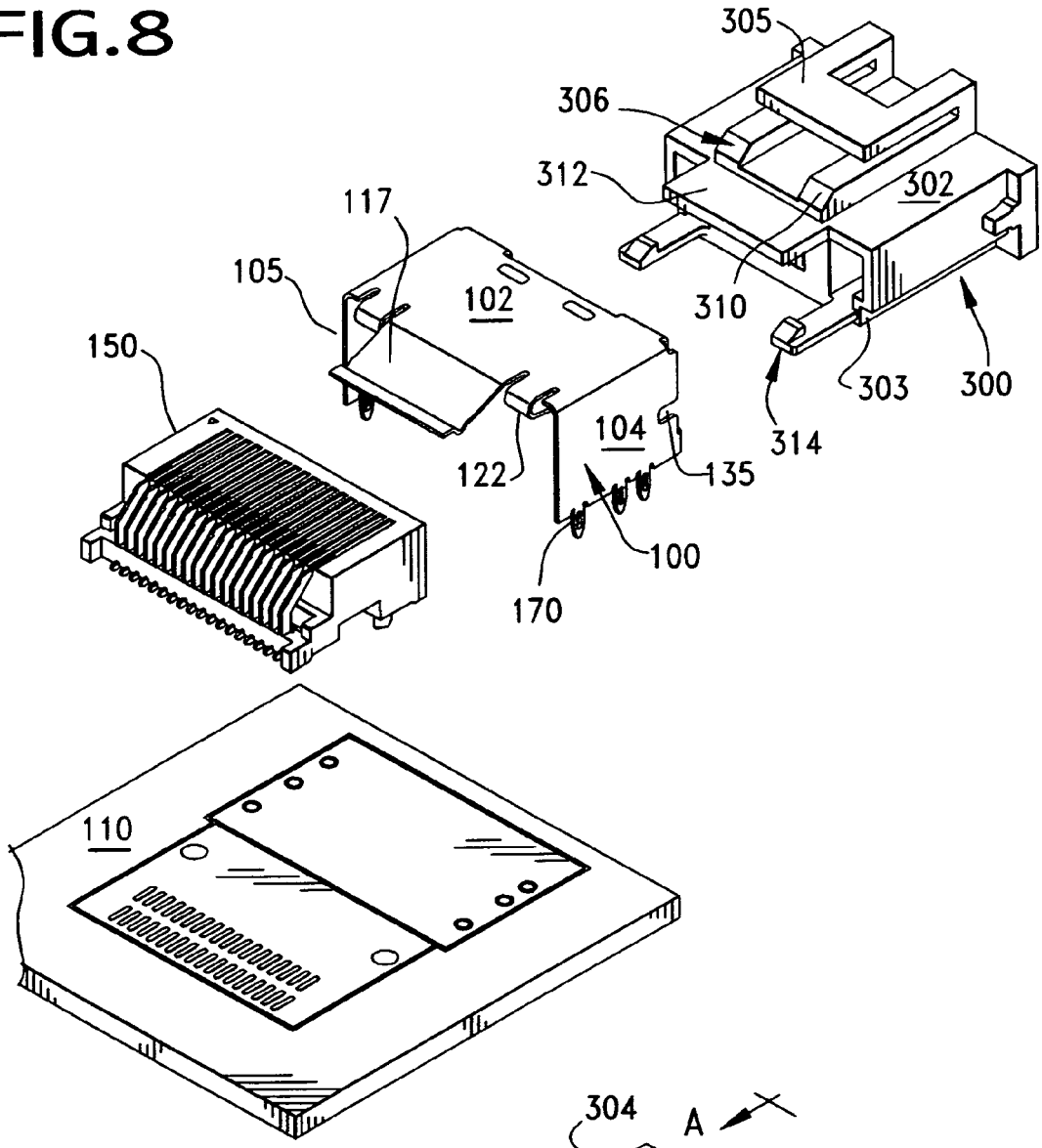
FIG. 8 is an exploded view of the circuit board connector, shroud of FIG. 1 and a placement member that is constructed in accordance with the principles of the present invention.
Figure 10:
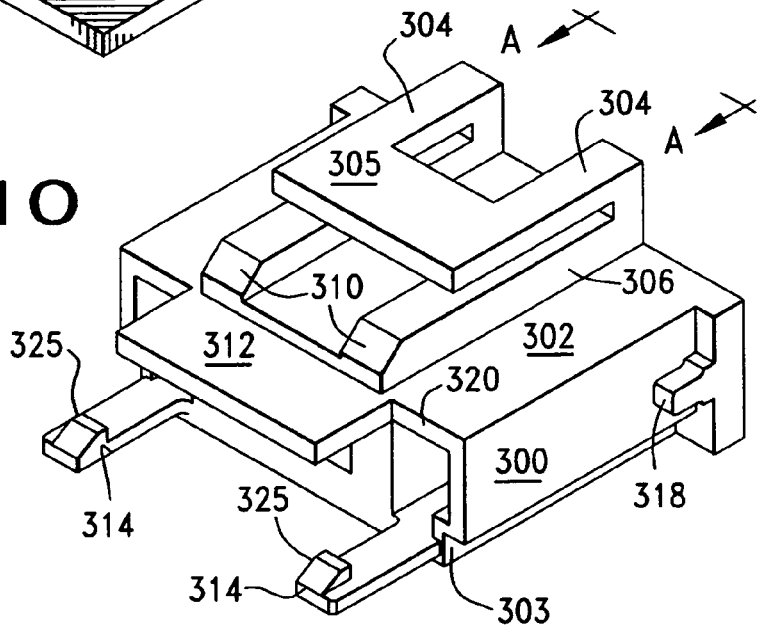
FIG. 10 is a perspective view of the placement member of FIG. 8.
Figure 9:
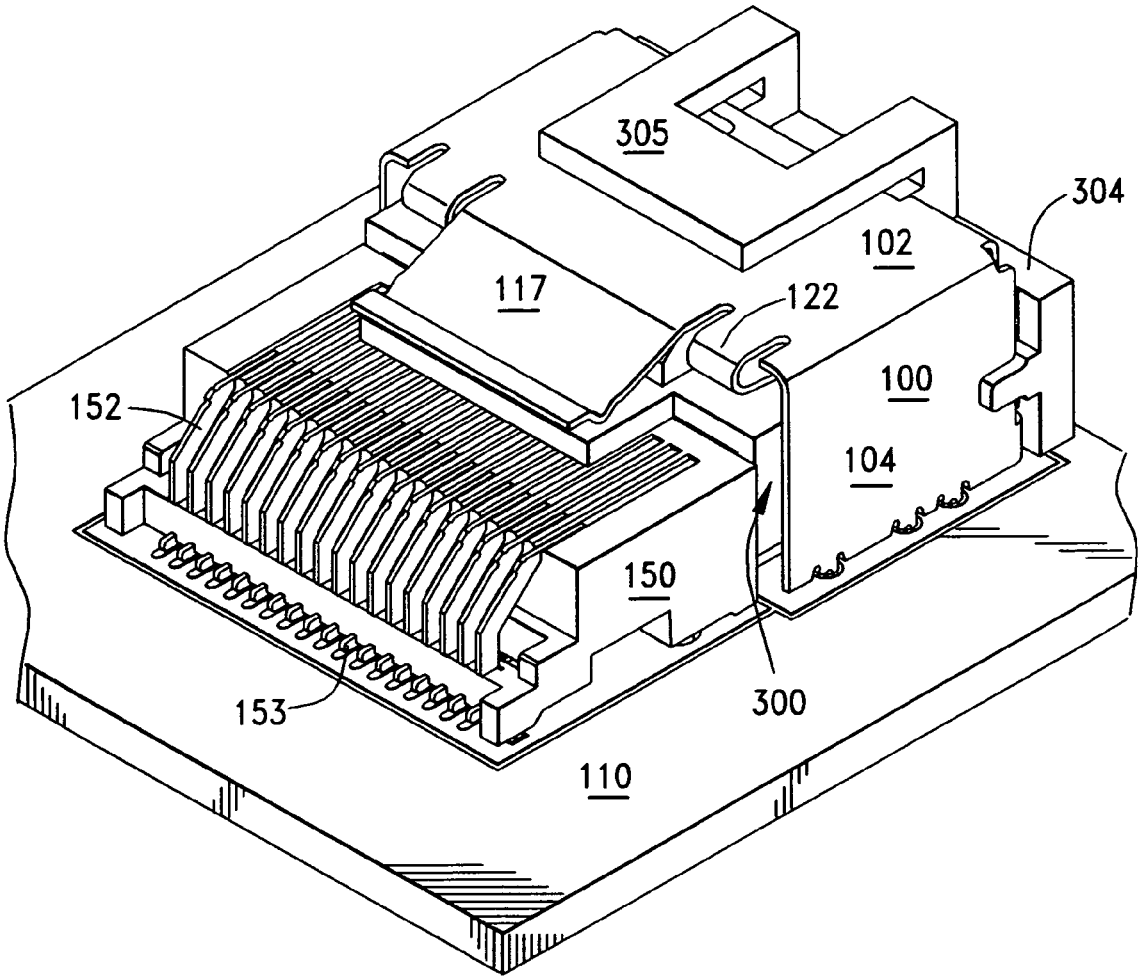
FIG. 9 is a perspective view of the placement member inserted into the shroud and engaged with the circuit board connector.
Figure 10A:
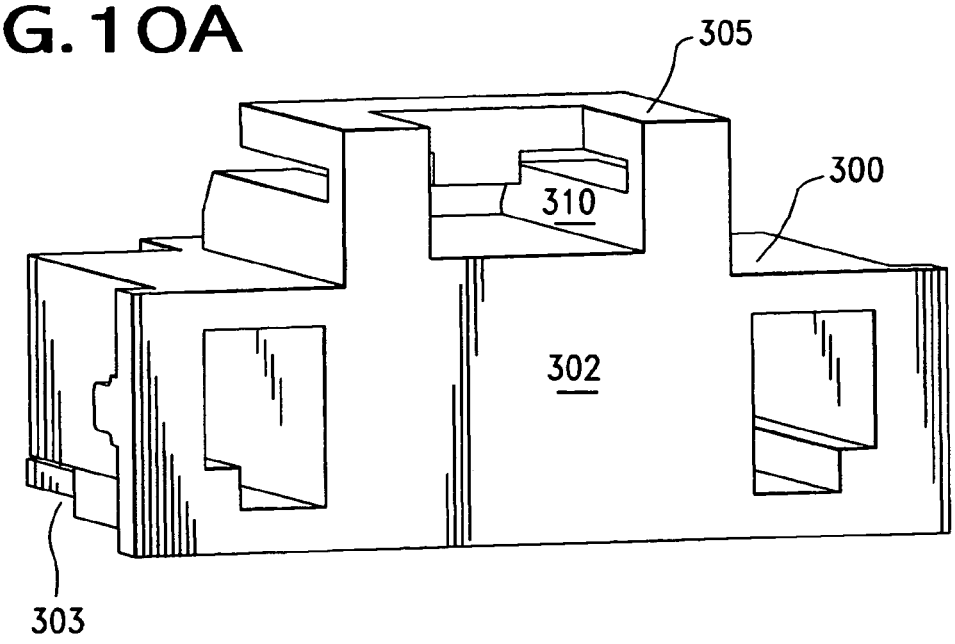
FIG. 10A is a slight perspective view of the front end of the placement member of FIG. 8.
Figure 11:
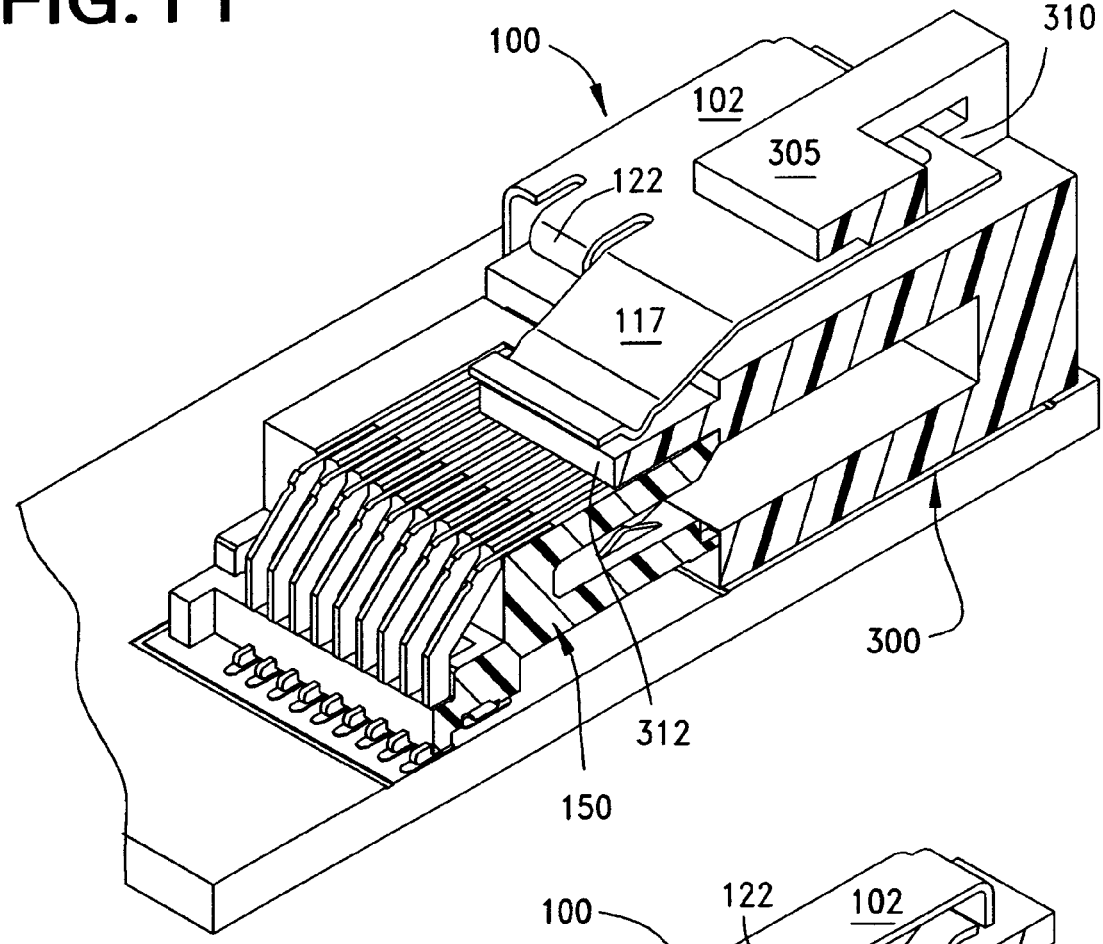
FIG. 11 is a sectional view of FIG. 10, taken along lines 11—11 thereof to illustrate the manner of engagement that the placement member has with the shroud and the circuit board connector.
Figure 12:
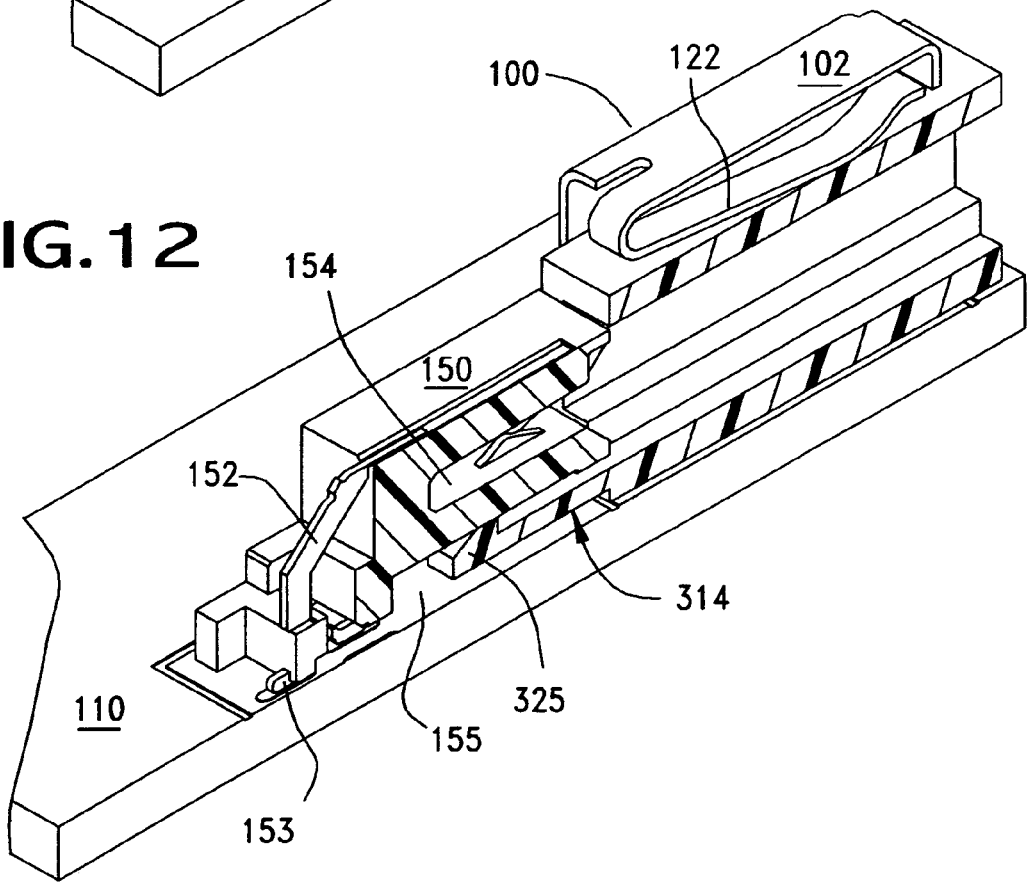
FIG. 12 is the same view as FIG. 11, but taken along a different location to illustrate the manner of engagement between the placement member and the circuit board connector.

The placement member 300 has notches 303 that engage the guide tabs 118 on the shroud so that the placement member may be positioned properly within the shroud 100. The notches 303 are shown in FIG. 10 as positioned along the bottom of the placement member, abut then may be oriented along the top thereof as well. As shown in FIG. 8, the shroud 100 used in this embodiment is a compressible mount to the circuit board 110, and so uses compliant pin tail portions 170. The placement member thus integrates the connector 150 and the shroud 100 into a single unit for easy robotic placement directly in place onto a circuit board without fear of significant deviation from its assigned position.

Figure 13:
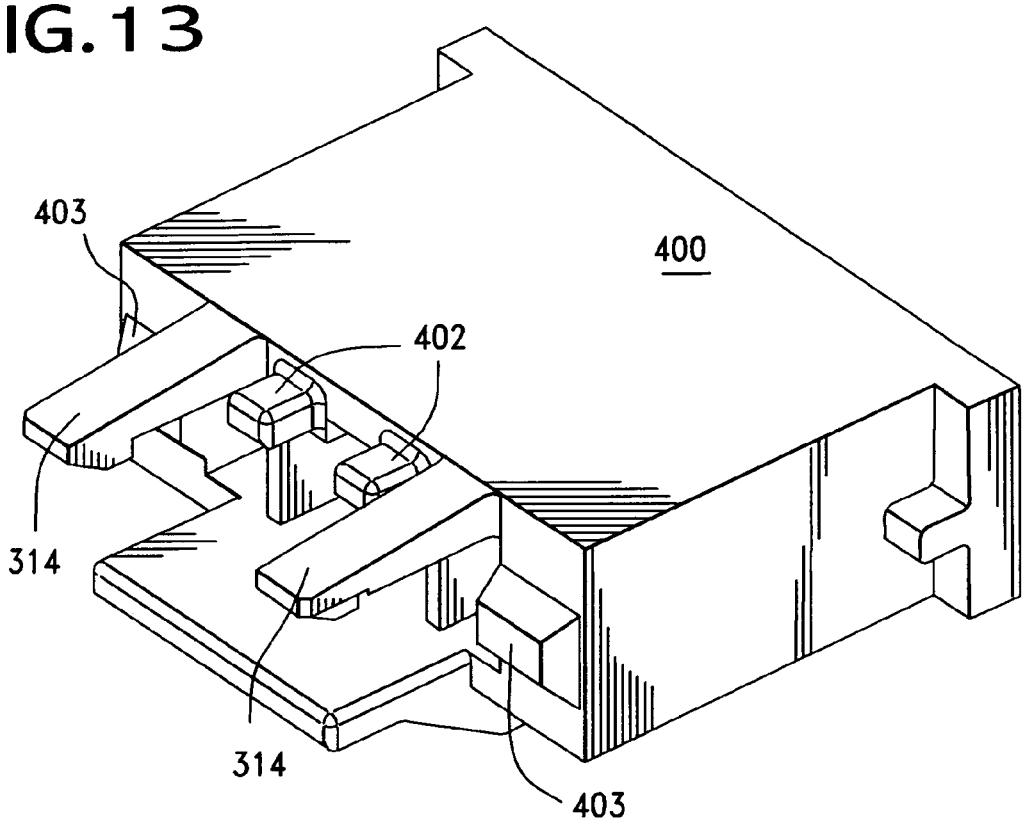
FIG. 13 is a perspective view of another embodiment of a placement member constructed in accordance with the principles of the present invention; and, FIG. 14 is the same view as FIG. 13, but with a vertical-style receptacle connector engaged and positioned on the placement member.
Figure 14:
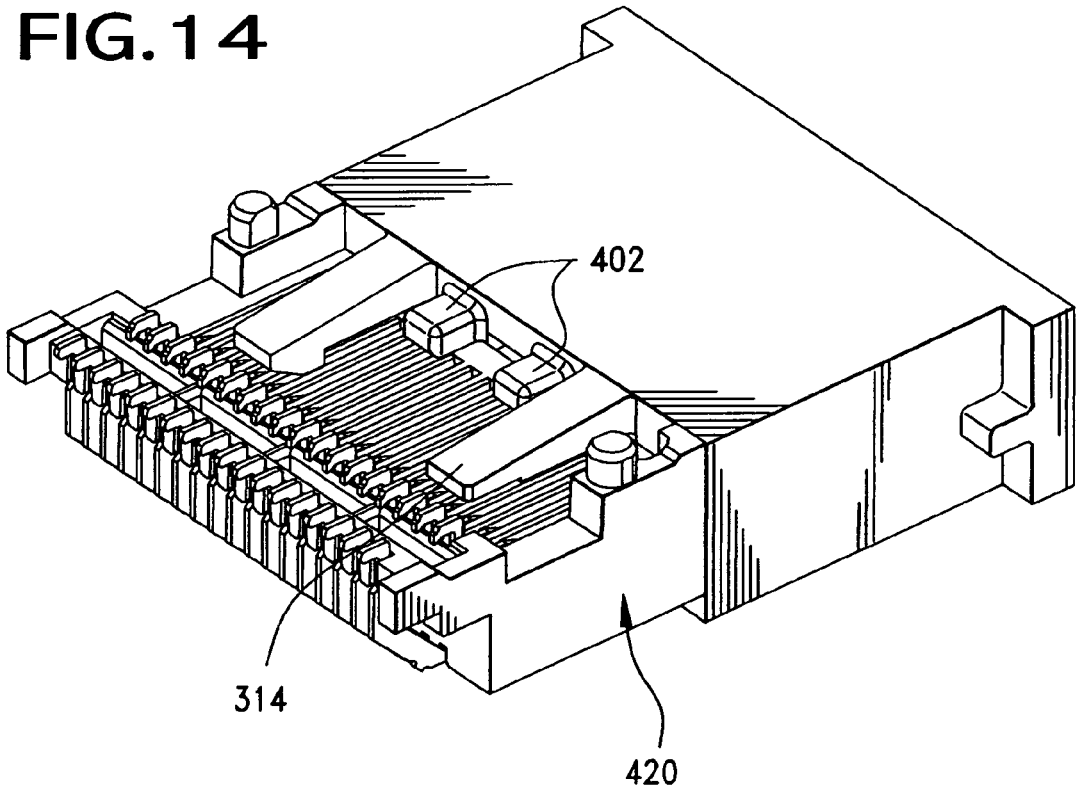

In the embodiment illustrated in FIGS. 13 and 14, the placement member 400 has the same structural components as the embodiment shown in FIGS. 8–12, with some additional aspects. A pair of stop members 402 may be formed on the face of the placement member and positioned between the secondary clips 314. These stops prevent the connector 420 from turning or twisting forward around the hook portions 314 as they press the connector against the protective tab. A pair of lugs 403 may also be formed on the face of the placement member in line with the card-receiving slot of the receptacle connector 420 (FIG. 14) to assist in positioning the connector 420 on the placement member. The connector may be either a right angle connector as shown in the drawings or it may be a vertical style connector.

While the preferred embodiments of the invention have been shown and described, it will be appreciated by those skilled in the art that changes and modifications may be made to these embodiments without departing from the spirit of the invention, the scope of which is defined by the appended claims.

What is claimed is:

1. An placement member for holding together a receptacle connector and a guide member for placement of the receptacle connector and the guide member onto a circuit board, said receptacle connector including a mating face for mating with an opposing plug connector, and said guide member including a shell with a top wall and two side walls that cooperatively define a hollow interior thereof, the placement member comprising:

a body portion, the body portion including opposite first and second ends, a protective blade projecting from the body first end, the protective blade being sized to be extend over a portion of a top surface of said receptacle connector received when said placement member is engaged with said receptacle connector, and means for holding said receptacle connector mating face adjacent said body first end; and, said body portion including a clip member proximate the body second end, the clip member for engaging and holding said guide member adjacent said body portion second end.

2. The placement member of claim 1, further including receptacle connector holding means includes a pair of engagement arms extending longitudinally from said body portion first end.

3. The placement member of claim 2, wherein the engagement arms include hook end portions.

4. The placement member of claim 2, wherein said receptacle connector holding means further includes a pair of stop members extending longitudinally from said body portion first end.

5. The placement member of claim 4, wherein said stop members are disposed on said body portion first end between said engagement arms.

6. The placement member of claim 1, wherein said clip member is cantilevered from said body portion second edge and is spaced apart from a top surface of said placement member, thereby defining a slot between said clip member and the body portion top surface, the slot receiving said guide member therein when said placement member is assembled to said guide member.

7. The placement member of claim 6, further including a pair of rails disposed on said body portion top surface, said slot being interposed between said clip member and the pair of rails.

8. The placement member of claim 7, wherein said rails include angled lead-in surfaces.

9. The placement member of claim 1, wherein said placement member include a flat planar pickup surface that can be engaged by a vacuum placement member.

10. The placement member of claim 1, wherein said pickup surface is disposed on said clip member and lies in a horizontal plane.

11. The placement member of claim 10, wherein said pickup surface is disposed on said body portion second end and lies in a vertical plane.

12. The placement member of claim 2, further including wherein said engagement arms have a first length and said protective blade has a second length, the first length being greater than the second length.

13. The placement member of claim 2, wherein said engagement arms exert an upward force on said receptacle connector when said placement member is assembled to said receptacle connector.

14. The placement member of claim 1, further including a pair of tabs projecting out from opposing sides of said placement member for engaging sides of said guide.

15. A placement member for removably interconnecting a connector to an associated conductive shroud together as a unit for pick up and placement onto a supporting circuit board, the placement member comprising:

an insulative body portion, the body portion having opposing first and second ends interconnected by at least one sidewall, said body portion including first means for holding the connector in opposition to the body portion first end, and second means for holding the shroud in position above and spaced apart from said connector, the second holding means extending above the one sidewall from the body portion second end toward said body portion first end, said second holding means defining a space above said one sidewall for receiving a portion of said shroud therein, said body portion further including a first planar surface for engagement by a pneumatic pick up device.

16. The placement member of claim 15, wherein said first holding means includes a pair of engagement arms extending forwardly of said body portion first end.

17. The placement member of claim 15, wherein said second holding means includes a clip member disposed on said body portion one sidewall, said clip member defining an intervening slot above said body portion sidewall which receives a portion of said shroud.

18. The placement member of claim 17, wherein said first holding means includes a pair of engagement arms extending forwardly from said body portion front end, the engagement arms including hook portion disposed thereon for engaging an underside of said connector.

19. The placement member of claim 15, further including a protective blade member projecting forwardly of said body portion first end, the protective blade defining a contact surface against which a portion of said shroud bears when said shroud is positioned on said placement member.

20. The placement member of claim 15, further including a second planar surface for engagement by a pneumatic pick up device, the first planar surface being disposed on a horizontal surface of said body portion and said second planar surface being disposed on a vertical surface of said body portion.

21. The placement member of claim 17, further including a pair of rails disposed on said body portion one sidewall in alignment with said clip member, the rails including lead-in surfaces angled toward said slot.

* * * * *